United States Patent [19]

Cha

[11] 4,246,965

[45] Jan. 27, 1981

[54] METHOD FOR OPERATING AN IN SITU OIL SHALE RETORT HAVING CHANNELLING

[75] Inventor: Chang Y. Cha, Bakersfield, Calif.

[73] Assignee: Occidental Oil Shale, Inc., Grand Junction, Colo.

[21] Appl. No.: 72,445

[22] Filed: Sep. 4, 1979

Related U.S. Application Data

[63] Continuation-in-part of Ser. No. 43,673, May 30, 1979, abandoned, which is a continuation of Ser. No. 888,301, Mar. 20, 1978, abandoned, which is a continuation-in-part of Ser. No. 844,035, Oct. 20, 1977, abandoned, which is a continuation-in-part of Ser. No. 728,991, Oct. 4, 1976, abandoned, which is a continuation-in-part of Ser. No. 648,358, Jan. 12, 1976, abandoned, which is a continuation of Ser. No. 465,097, Apr. 29, 1974, abandoned.

[51] Int. Cl.[3] ..... E21B 43/24

[52] U.S. Cl. ..... 166/251; 166/260; 166/261; 299/2

[58] Field of Search ..... 166/251, 256, 259, 260, 166/261, 271, 272, 247; 299/2, 4, 13

[56] References Cited

U.S. PATENT DOCUMENTS

| | | | |
|---|---|---|---|
| 2,801,089 | 7/1957 | Scott, Jr. | 299/2 |
| 3,001,776 | 9/1961 | van Poollen | 299/2 |
| 3,362,471 | 1/1968 | Slusser et al. | 166/251 |
| 3,537,528 | 11/1970 | Herce et al. | 166/259 X |
| 3,565,174 | 2/1971 | Parker et al. | 166/261 |
| 3,586,377 | 6/1971 | Ellington | 299/2 X |
| 3,601,193 | 8/1971 | Grady | 166/259 X |
| 3,661,423 | 5/1972 | Garrett | 299/13 X |
| 3,951,456 | 5/1976 | Ridley | 166/259 X |
| 4,031,956 | 6/1977 | Terry | 166/261 |

OTHER PUBLICATIONS

Burwell et al., "Krypton 85 Tracer Aids Evaluation of Underground Combustion Oil-Recovery Tests", *Producers Monthly,* vol. 29, No. 1, Jan. 1965, pp. 21, 22 and 23.

*Primary Examiner*—Stephen J. Novosad
*Attorney, Agent, or Firm*—Christie, Parker & Hale

[57] ABSTRACT

An in situ oil shale retort contains a fragmented permeable mass of formation particles containing oil shale and has a primary combustion zone advancing through a first region having a first fluid flow path, and a second region having a second fluid flow path. The first and second paths have different gas permeabilities. An oxygen containing retort inlet mixture is introduced to the fragmented mass for advancing the primary combustion zone through the fragmented mass and for flow of gas along the first and second flow paths.

To maintain a substantially flat primary combustion zone, gas flowing through the first fluid path is maintained at a first average temperature and gas flowing through the second fluid path is maintained at a sufficiently different average temperature to provide substantially equal rates of advancement of the combustion zone through the fragmented mass in the first and second regions.

This can be effected by maintaining the temperature, composition, and/or oxygen mass flow rate of gas introduced to the first region different from the temperature, composition and/or oxygen mass flow rate of gas introduced to the second region.

64 Claims, 4 Drawing Figures

METHOD FOR OPERATING AN IN SITU OIL SHALE RETORT HAVING CHANNELLING

CROSS-REFERENCES

This application is a continuation-in-part of application Ser. No. 043,673, filed May 30, 1979, now abandoned, which is a continuation of patent application Ser. No. 888,301, filed Mar. 20, 1978, now abandoned; which is a continuation-in-part of application Ser. No. 844,035, filed Oct. 20, 1977, now abandoned; which is a continuation-in-part of application Ser. No. 728,991, filed Oct. 4, 1976, now abandoned; which is a continuation-in-part of application Ser. No. 648,358, filed Jan. 12, 1976, now abandoned; which is a continuation of application Ser. No. 465,097, filed Apr. 26, 1974; and now abandoned. The disclosures of these six patent applications are incorporated herein by this reference.

BACKGROUND OF THE INVENTION

The presence of large deposits of oil shale in the Rocky Mountain regions of the United States have given rise to extensive efforts to develop methods of recovering shale oil from kerogen in the oil shale deposits. It should be noted that the term "oil shale" as used in the industry is in fact a misnomer; it is neither shale, nor does it contain oil. It is a sedimentary formation comprising marlstone deposit and including dolomite with layers containing an organic polymer called "kerogen", which, upon heating, decomposes to produce liquid and gaseous products. It is the formation containing kerogen that is called "oil shale" herein, and the liquid hydrocarbon product is called "shale oil".

A number of methods have been proposed for processing the oil shale which involve either first mining the kerogen-bearing shale and processing the shale on the surface, or processing the shale in situ. The latter approach is preferable from the standpoint of environmental impact, since the treated shale remains in place, reducing the chance of surface contamination and the requirement for disposal of solid wastes.

The recovery of liquid and gaseous products from oil shale deposits has been described in several patents, such as U.S. Pat. Nos. 3,661,423; 4,043,595; 4,043,596; 4,043,597; 4,043,598, and 4,118,701. These patents are incorporated herein by this reference. Such patents describe in situ recovery of liquid and gaseous hydrocarbon materials from a subterranean formation containing oil shale by fragmenting such formation to form a stationary, fragmented, permeable body or mass of formation particles containing oil shale within the formation, referred to herein as an in situ oil shale retort. Hot retorting gases are passed through the in situ oil shale retort to convert kerogen contained in the oil shale to liquid and gaseous products, thereby producing retorted oil shale.

One method for forming an in situ oil shale retort as described in U.S. Pat. No. 4,043,595 includes excavating a first portion of the formation from within the boundaries of the in situ oil shale retort being formed to form a void, where the surface of the formation defining the void provides at least one free face extending through the formation within the boundaries. A second portion of the formation is explosively expanded toward the void to form an in situ oil shale retort containing a fragmented permeable mass of formation particles. The fragmented permeable mass in the retort has a void fraction which is equal to the ratio of the volume of the void to the combined volume of the void and the space occupied by the second portion of the formation. As used herein the term "void fraction" refers to the ratio of the volume of the voids or spaces between particles in the fragmented mass to the total volume of the fragmented permeable mass of particles in an in situ oil shale retort. For example, in a fragmented mass with a void fraction of 20%, 80% of the volume is occupied by particles, and 20% is occupied by the spaces between particles.

One method for supplying hot retorting gases used for converting kerogen contained in the oil shale, as described in U.S. Pat. No. 3,661,423, includes establishment of a primary combustion zone in the retort and introduction of an oxygen-containing retort inlet mixture into the retort as an oxygen-containing gaseous primary combustion zone feed to advance the primary combustion zone through the retort. In the primary combustion zone, oxygen in the primary combustion zone feed is depleted by reaction with hot carbonaceous materials to produce heat, combustion gas, and combusted oil shale. By the continued introduction of the retort inlet mixture into the retort, the primary combustion zone is advanced through the fragmented mass in the retort.

The combustion gas and the portion of the primary combustion zone feed that does not take part in the combustion process pass through the fragmented mass in the retort on the advancing side of the primary combustion zone to heat the oil shale in a retorting zone to a temperature sufficient to produce kerogen decomposition, called retorting, in the oil shale to gaseous and liquid products, including gaseous and liquid hydrocarbon products, and to a residual solid carbonaceous material.

The liquid products and gaseous products are cooled by the cooler oil shale fragments in the retort on the advancing side of the retorting zone. The liquid hydrocarbon products, together with water produced in or added to the retort, are collected at the bottom of the retort. An off gas containing combustion gas, gaseous products produced in the retorting zone, carbon dioxide from carbonate decomposition, and any gaseous retort inlet mixture that does not take part in the combustion process, is also withdrawn from the bottom of the retort.

When preparing an in situ oil shale retort, the void fraction may not be uniform throughout the entire fragmented mass. For example, the fragmented mass can contain two fluid flow paths between the inlet and outlet of the retort, where one of the fluid flow paths has a relatively lower flow resistance than the other fluid flow path. When processing the fragmented mass to recover shale oil, there is a tendency for gas introduced to the retort to channel along the flow path of relatively lower flow resistance. This channelling can result in a warped combustion zone, where a portion of the combustion zone advancing along the flow path of relatively lower flow resistance is farther advanced than a portion of the combustion zone advancing along the flow path of relatively higher flow resistance.

This is undesirable because it is found that the best yield of shale oil from oil shale is obtained when the primary combustion zone moves through the retort as a substantially flat zone which is substantially uniformly perpendicular to its direction of advancement. When the primary combustion zone is skewed and/or warped some of the shale oil produced may be burned, thereby reducing the total yield. In addition, with a skewed and/or warped primary combustion zone, excessive cracking of hydrocarbon products produced in the retorting zone can result. It is, therefore, desirable to have the primary combustion zone progress through the fragmented mass as a substantially flat horizontal wave.

Therefore, there is a need for a method for operating an in situ oil shale retort having fluid flow paths of different gas flow resistance where the primary combustion zone is advanced through the fragmented mass as a substantially flat zone which is substantially uniformly perpendicular to its direction of advancement.

SUMMARY

The present invention concerns a process for promoting a substantially flat primary combustion zone in an in situ fragmented permeable mass of formation particles containing oil shale. The fragmented mass contains a first region having a first fluid flow path therethrough and a second region having a second fluid flow path therethrough. The first path has a first gas permeability and the second path has a second gas permeability different from the first gas permeability. A retort inlet mixture containing oxygen is introduced to the fragmented mass for advancing a primary combustion zone through the fragmented mass and for flow of gas along the first and second flow paths.

Gas flowing through the first fluid flow path has a first average temperature and gas flowing through the second fluid flow path has a second average temperature. To provide substantially equal rates of advancement of the primary combustion zone through the fragmented mass in the first and second regions, the second average temperature is sufficiently different from the first average temperature.

In addition to or instead of maintaining the first and second average temperatures different from each other, gas flowing through the first fluid path can have a first oxygen mass flow rate, and gas flowing through the second flow path can have a second oxygen mass flow rate which is different from the first oxygen mass flow rate for equalizing the rate of advancement of the primary combustion zone through the first and second regions.

For example, if the second path has a relatively higher gas permeability, the gas flowing through the second flow path is maintained at an average temperature which is higher than the average temperature of gas flowing through the first flow path, and the oxygen mass flow rate through the second flow path is maintained lower than the oxygen mass flow rate through the first flow path. Such a difference in the temperature of gas flowing through the two flow paths can be achieved by introducing retort inlet mixtures having different compositions and/or temperatures to the two regions in the fragmented mass.

In a preferred version of the invention, fuel is introduced as part of the retort inlet mixture introduced to the region of the fragmented mass containing the flow path having a relatively higher gas permeability for establishing a secondary combustion zone on the trailing side of the primary combustion zone in this region. This raises the temperature of gas entering the portion of the primary combustion zone in this region as well as decreasing the oxygen concentration and oxygen mass flow rate of gas passing into the portion of the primary combustion zone in this region.

DRAWINGS

These and other features, aspects, and advantages of the present invention will become more apparent when considered with respect to the following description, appended claims, and accompanying drawings where:

DESCRIPTION

Figure 2:
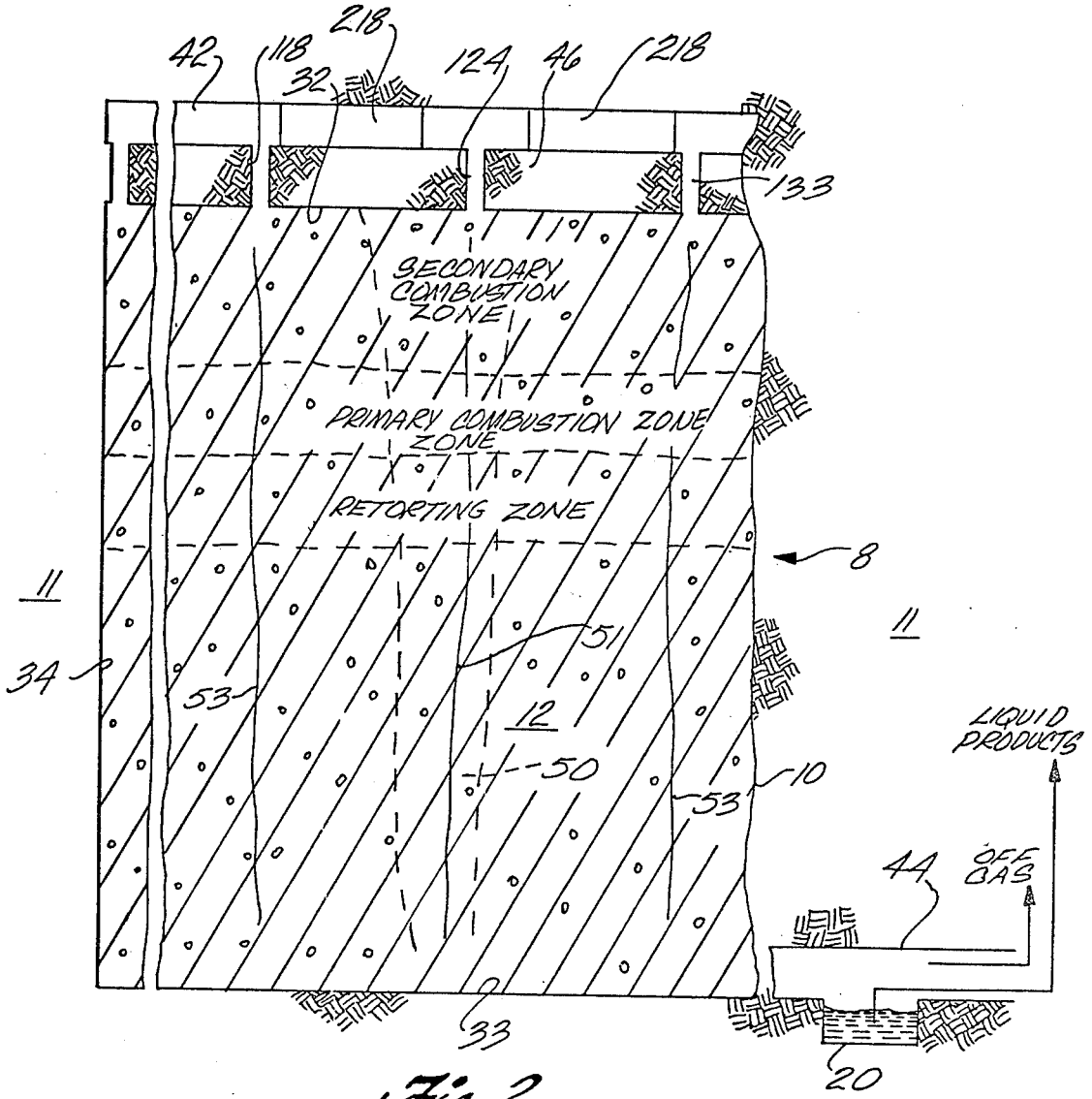
FIG. 2 is a semi-schematic view of the retort of FIG. 1 taken on line 2—2 in FIG. 1.

Referring to FIG. 2, an in situ oil shale retort 8 is in the form of a cavity 10 in a subterranean formation 11 containing oil shale. The in situ retort contains a fragmented permeable mass 12 of formation particles containing oil shale. The retort has top 32, bottom 33, and side 34 boundaries of unfragmented formation serving as gas barriers. The cavity and fragmented mass of oil shale particles can be created simultaneously by blasting by any of a variety of techniques. Methods for forming an in situ oil shale retort are described in the aforementioned U.S. Pat. Nos. 3,661,423; 4,043,595; 4,043,596; 4,043,597; 4,043,598; and 4,118,071.

A method for forming an in situ oil shale retort as described in the aforementioned U.S. Pat. No. 4,118,071 is useful for explanation. With reference to FIG. 2, a portion of the formation is excavated to form a base of operation 42 on an upper working level. The term "working level" refers to the general elevation in a subterranean formation at which underground workings or galleries are excavated and utilized in the formation of a fragmented mass below a horizontal sill pillar in a retort being formed. Underground workings include excavations of any desired configuration, such as drifts, adits, tunnels, cross-cuts, rooms, or the like. A drift 44 or similar means of access is excavated through formation at a lower level to a location underlying the base of operation. Such lower level is identified herein as a "production level" which designates underground workings at an elevation in the formation at or below the bottom of such an in situ retort.

In preparing such a retort, at least one void is excavated from within the boundaries of the fragmented mass being formed, such a void being connected to the access drift on the production level underlying the base of operation. This leaves another portion of the formation within the boundaries of the retort being formed which is to be fragmented by explosive expansion toward such void. The void is excavated only to an elevation above the access drift that leaves a horizontal sill pillar 46 of unfragmented formation between the top of the void and the bottom of the base of operation. As used herein, the term "horizontal sill pillar" refers to unfragmented formation between a working level and the top boundary of a fragmented mass. The surface of the formation defining the void provides at least one free face which extends through the formation. The remaining portion of the formation within the boundaries of the retort being formed is explosively expanded towards such a free face. The vertical thickness of the horizontal sill pillar is sufficient to maintain a safe base of operation 42 over the fragmented mass after such explosive expansion.

In the exemplary embodiment, a plurality of vertically extending blasting or bore holes including blasting holes 118, 119, 120, 124, 129, 133, 134, 135, and 136 are drilled through the sill pillar into formation remaining below the sill pillar. The blasting holes are shown in the drawings out of proportion, i.e., the blasting holes can be smaller in diameter relative to the horizontal cross-sectional dimensions of the retort than shown in the drawings, e.g., the base of operation can be 120 feet across and the blasting holes can be about 10 inches in diameter. Explosive is loaded into such blasting holes from the base of operation up to an elevation about the same as the bottom of the horizontal sill pillar, which is to remain unfragmented. Such explosive is detonated for explosively expanding subterranean formation toward such void below the sill pillar.

The portion of such blasting holes extending through the sill pillar can be used for introducing gas to the fragmented mass 12 from the base of operation 42 during the retorting process.

In preparing an in situ oil shale retort according to this method and other methods, there can be regions in the fragmented mass having different gas permeabilities. For example, the region 50 shown in FIGS. 1 and 2 can be a region in the fragmented mass having a relatively lower gas permeability, while the remainder of the fragmented mass has a relatively higher gas permeability. The region of relatively lower permeability also has a relatively lower void fraction. A fluid flow path 51 between the inlet and outlet of the retort through the region of relatively higher gas permeability has a gas flow resistance which is relatively lower than the gas flow resistance of fluid flow paths 53 through the remainder of the fragmented mass. As used herein, the terms "flow resistance", "permeability", and "void fraction", refer to fragmented mass at ambient temperature before regions of fragmented mass are heated to different temperatures in accordance with methods according to the present invention.

The fluid flow paths 51 and 53 are parallel to each other in terms of resistance to gas flow, somewhat analogous to parallel resistors in an electrical circuit. It is desirable to maintain the effective flow resistance (per unit area) similar in the parallel fluid flow paths so that the gas flow rate through the paths is similar and the primary combustion zone advances at a similar rate along each path.

During operation of the retort 8, gases passing through the retort can channel along the low resistance fluid flow path 51, resulting in uneven advancement of a primary combustion zone and a retorting zone through the fragmented mass. Such channelling of gas can greatly decrease yield of liquid and gaseous products from the retort. This can occur because the portion of the primary combustion zone in the region of high gas permeability can be further advanced through the fragmented mass than portions of the retorting zone are advanced through the other portions of the fragmented mass. This has actually been observed. Products produced in the retorting zone can be consumed by oxidation in an advanced portion of the primary combustion zone. In addition, liquid products produced in the retorting zone can be excessively cracked to less valuable gaseous products in an advanced portion of the primary combustion zone.

Another reason why such gas channelling can reduce yields from the retort 8 is that it can be necessary to prematurely shut down operation of the retort. This is because the advanced portions of the retorting and primary combustion zones can approach the bottom 33 of the retort while trailing portions of the retorting and primary combustion zones are at a substantially higher elevation in the fragmented mass. Due to the presence of the retorting and primary combustion zones near the bottom of the retort, the liquid products and off gas can have a temperature higher than the permissible operating temperature of liquid product and off gas collection and processing equipment.

The presence of a fluid flow path having a relatively lower fluid flow resistance in the fragmented mass can be detected before and/or after commencement of operation of the retort 8. For example, a gas flow path having a relatively high permeability can be identified before beginning operation of the retort 8 by passing gaseous tracers such as radioactive krypton through the fragmented mass 12. Such a tracer test involves injection of a "slug" of radioactive krypton into the retort at a selected location in the fragmented mass and measurement of the krypton count in gas withdrawn from the retort. When the fragmented mass is uniformly permeable, a single peak results. In the presence of channeling, however, there is an initial peak as a slug of gas flows through the channel followed by a later peak as gas flows through non-channeled regions. By injecting krypton at various points in the fragmented mass, the location of channels can be identified.

After establishment of a combustion zone in the fragmented mass 12, a variety of techniques can be used to determine if the primary combustion zone is substantially flat and uniformly transverse and perpendicular to the direction of its advancement through the fragmented mass, or if channeling is occurring. Exemplary of such techniques is the method described in U.S. patent application Ser. No. 796,700, filed on May 13, 1977, by Gordon B. French, now U.S. Pat. No. 4,151,877, entitled "Determining the Locus of a Processing Zone in a Retort through Channels," and incorporated herein by this reference. According to this patent, the locus of a primary combustion zone is an in situ oil shale retort can be determined by withdrawing a sample of gas from the retort through a channel in unfragmented formation adjacent the retort, where the channel is in fluid communication with the retort. By analyzing the composition of the withdrawn gas for a constituent such as oxygen, the locus of the primary combustion zone can be determined. To determine whether the primary combustion zone is skewed and/or warped, gas samples can be withdrawn from the retort at a plurality of locations spaced apart from each other in a plane substantially normal to the direction of advancement of the primary combustion zone.

Another technique for determining if a primary combustion zone is non-planar and/or skewed is described in U.S. patent application Ser. No. 798,076 filed on May 18, 1977, by W. Brice Elkington, now U.S. Pat. No. 4,082,145, entitled "Determining the Locus of a Processing Zone in an In Situ Oil Shale Retort by Sound Monitoring," and incorporated herein by this reference. According to this Patent, the locus of a primary combustion zone advancing through a fragmented permeable mass of particles in an oil shale retort can be determined by monitoring for sound produced in the retort. Sound preferably is monitored at at least two locations, and more preferably, at at least three locations in a plane substantially normal to the direction of advancement of the primary combustion zone through the fragmented mass to determine if the primary combustion zone is flat and uniformly transverse to its direction of advancement. Monitoring can be effected by placing one or more sound transducers in a conduit extending into the fragmented mass and/or in a well extending through the formation adjacent the retort. Sound transducers are sensitive to sound intensity and/or to sounds characterizing a primary combustion zone for distinguishing the sounds of a primary combustion zone from those produced in other portions of the retort.

A further technique for determining the locus of a primary combustion zone advancing through a retort is described in U.S. patent application Ser. No. 798,376, filed on May 9, 1977, by Robert S. Burton, entitled "Use of Containers for Dopants to Determine the Locus of a Processing Zone in a Retort," now abandoned, assigned to the assignee of this application, and incorporated herein by this reference. According to this technique, container means for confining indicator means for providing an indicator for release at a predetermined temperature greater than ambient is placed at a selected location in a subterranean formation containing oil shale within the boundaries of an in situ oil shale retort to be formed in the formation. Then the formation within the boundaries of the in situ oil shale retort to be formed is explosively fragmented to form an in situ retort containing a fragmented permeable mass of formation particles which contains the container. A primary combustion zone is then advanced through the fragmented mass to form an effluent fluid such as off gas or shale oil and to release indicator means from the container. Effluent fluid from the retort is monitored for presence of indicator to determine the locus of the primary combustion zone. By placing such container means spaced apart from each other in a plane substantially perpendicular to the direction of advancement of the primary combustion zone, it can be determined whether the primary combustion zone is skewed and/or warped.

By using one or more of these techniques, or other techniques, such as thermocouples to measure temperature in the retort, it can be determined whether the primary combustion zone is substantially flat and horizontal. If it is determined that the primary combustion zone is warped and/or skewed, corrective measures according to the present invention can be taken.

According to the present invention, the regions in the fragmented mass with relatively low gas flow resistance, and therefore regions where channeling can occur, are identified. A primary combustion zone is established in an upper portion of the fragmented mass near the top boundary, where the primary combustion zone extends generally horizontally in the fragmented mass. A retort inlet mixture is introduced to the fragmented mass for advancing the primary combustion zone through the fragmented mass. In order to advance all portions of the primary combustion zone through the fragmented mass at about the same rate, gas flowing through the gas flow path 51 of relatively lower gas flow resistance is maintained at an average temperature sufficiently higher than the average temperature of gas flowing through gas flow paths 53 of relatively higher gas flow resistance to provide substantially equal rates of advancement if the combustion zone through the fragmented mass. As described in more detail hereinbelow, this can be effected by maintaining the temperature and/or composition of gas introduced to the region 50 of relatively higher permeability different from the termperature and/or composition of gas introduced to the regions of relatively lower permeability in the fragmented mass.

As used herein, the average temperature, $T_a$ is defined by the following equation: $T_a = \int T_i dx / X$ where $T_i$ = the temperature of gas in the fragmented mass at a distance, x, from the top of the fragmented mass; and where X is equal to the length of the gas flow path over which the integral $\int T_i dx$ is taken.

To establish a primary combustion zone in the fragmented mass, carbonaceous material in the oil shale is ignited by any known method as, for example, the methods described in U.S. Pat. No. 3,952,801, incorporated herein by this reference, or above-mentioned U.S. Pat. No. 3,661,423. In establishing a primary combustion zone by a method as described in the U.S. Pat. No. 3,661,423, a combustible mixture is introduced into the retort through the conduits through the sill pillar 46 and ignited. Retort off gas is withdrawn through the drift 44, thereby bringing about a movement of gas from top to bottom of the retort 8 through the fragmented permeable mass of particles containing oil shale. The combustible mixture contains an oxygen containing gas and a fuel such as propane, butane, shale oil, diesel fuel, natural gas or the like.

As used herein, the term "oxygen containing gas" refers to oxygen; air; air enriched with oxygen; air mixed with a diluent such as nitrogen, off gas from an in situ oil shale retort, or steam; and mixtures thereof.

The supply of combustible mixture to the primary combustion zone is maintained for a period sufficient for oil shale in the fragmented mass near the upper boundary 32 of the retort to become heated to a temperature higher than the spontaneous ignition temperature of carbonaceous material in the shale, and generally higher than about 900° F., so the primary combustion zone can be sustained by the introduction of oxygen containing gas without fuel. At a temperature higher than about 900° F., gas passing through the primary combustion zone and combustion gas produced in the primary combustion zone are at a sufficiently high temperature to retort oil shale on the advancing side of the primary combustion zone.

The period for establishing a self-sustaining primary combustion zone can be from a few hours to a few days in duration. When a self-sustaining primary combustion zone has been formed, the retort off gas has little or no oxygen content because oxygen in the combustible mixture is depleted as the combustible mixture passes through the primary combustion zone. Multiple ignition points can be used for establishing a primary combustion zone. The number of ignition points required depends upon the lateral extent of the retort.

After a self-sustaining primary combustion zone is formed, a retort inlet mixture comprising an oxygen containing gas is introduced to the retort on the trailing side of the primary combustion zone through the conduits through the sill pillar. By the continued introduction of the retort inlet mixture, the primary combustion zone is advanced downwardly through the fragmented mass.

When establishing a primary combustion zone across the top of a fragmented mass, enhanced lateral propagation of the primary combustion zone can be effected by establishing a secondary combustion zone at the top of the fragmented mass. When using this technique, the retort inlet mixture introduced to regions of the fragmented mass having a relatively higher void fraction contains sufficient fuel that substantially all the oxygen in the retort inlet mixture is consumed. This generates a hot combustion gas substantially free of free oxygen for inhibiting advancement of the primary combustion zone into the portion of the fragmented mass having a relatively higher void fraction. This serves to retard the advancement of the primary combustion zone through channeled regions in the fragmented mass.

A hot combustion gas is produced in the primary combustion zone. The combustion gas and any unreacted portion of the retort inlet mixture pass from the advancing side of the primary combustion zone downwardly through a retorting zone in which gaseous and liquid products are produced by retorting oil shale.

The liquid and gaseous products produced in the retorting zone flow downwardly through the mass 12 of formation particles on the advancing side of the retorting zone into the drift 44 in communication with the bottom of the retort. The drift contains a sump 20 in which liquid products including shale oil and water are collected and from which liquid products are withdrawn through conduit means, not shown. A retort off gas containing gaseous products, combustion gas, carbon dioxide from carbonate decomposition, and any gaseous unreacted portion of the retort inlet mixture is also withdrawn by way of the drift.

Retorting of oil shale can be carried out with primary combustion zone temperatures as low as about 800° F. However, in order to have retorting at an economically fast rate, it is preferred to maintain the primary combustion zone at least at about 900° F. Preferably the primary combustion zone is maintained at a temperature of at least about 1150° F. for reaction between water and carbonaceous residue in retorted oil shale according to the water gas reaction.

The upper limit on the temperature of the primary combustion zone, and the upper limit on the temperature of a secondary combustion zone, if any, are determined by the fusion temperature of oil shale, which is about 2100° F. The temperatures of the primary and secondary combustion zones preferably are maintained below about 1800° F. to provide a margin of safety below the fusion temperature of the oil shale.

To maintain the rate of advancement of the primary combustion zone along the flow path 51 of relatively lower flow resistance and the gas flow paths 53 of relatively higher flow resistance substantially the same, fragmented mass along the flow path 51 of relatively lower gas flow resistance is maintained at a higher average temperature than the fragmented mass along the flow paths 53 of relatively higher gas flow resistance. This mode of operation of the retort 8 takes advantage of the phenomenon that the amount the particles in the fragmented mass thermally degrade during the processing of oil shale in the fragmented mass is proportional to the temperature of the particles. Thermal degradation of the particles decreases the size of the particles, thereby increasing the pressure gradient and decreasing the permeability of the fragmented mass. Because the particles in the region 50 have higher average temperature than the particles along the flow paths 53, they tend to be degraded more than the particles along the flow paths 53, and thus the effective permeability throughout the fragmented mass 12 tends to be equalized. The amount of difference between the temperature of particles along the various flow paths through the fragmented mass required for equalizing the pressure gradient throughout the fragmented mass depends on the initial disparity in void fraction.

Other factors, in addition to the hotter particles of the fragmented mass along the flow path 51 of a relatively lower gas flow resistance tending to degrade more than the colder particles in the fragmented mass along the flow paths 53 of relatively higher gas flow resistance, result in equalization of mass flow rate along the various flow paths in the fragmented mass. For example, the amount the particles in the fragmented mass thermally swell during processing is proportional to the temperature of the particles at temperatures of less than 1000° F. Therefore, by maintaining the particles in the fragmented mass along the flow paths 53 of relatively higher flow resistance below about 1000° F., the effective void fraction and the effective permeability throughout the fragmented mass 12 tend to be equalized. In addition, gas flowing along the relatively lower resistance flow path 51 has a higher average temperature than the gas flowing along other flow paths 53 in the fragmented mass. Because the volume and viscosity of a gas increase as the temperature of the gas increases, this tends to increase the pressure gradient along the relatively higher resistance flow path 51. Furthermore, more volatilized hydrocarbons are released by decomposition of kerogen in the oil shale, and more carbon dioxide is released due to decomposition of alkaline earth metal carbonates present in oil shale, as the temperature of the fragmented mass increases. This also results in the pressure gradient along the relatively higher resistance flow path 51 tending to increase.

It is axiomatic that the pressure drop from the inlet of the retort to the outlet of the retort is the same, regardless of the flow path followed. Therefore, because the fragmented mass along the relatively lower resistance path 51 has a higher average temperature, lower density, and higher viscosity than the fragmented mass along other flow paths, the mass flow rate of the gas along the flow path 51 is reduced relative to the mass flow rate of gas along the relatively higher gas flow resistance paths 53.

As used herein the terms "volumetric flow rate" and "mass flow rate" refer to cubic feet per square foot of fragmented mass cross sectional area per unit time and pound mass per square foot of fragmented mass cross sectional area per unit time, respectively.

It should be noted that the mass flow rate along the relatively lower gas flow resistance path 51 is not necessarily less than along the relatively higher flow resistance paths 53, although this can be achieved. A purpose of maintaining the average temperatures of flow paths in the fragmented mass different is to at least narrow the difference in mass flow rates along the two paths. By judiciously controlling the temperatures along the various flow paths through the fragmented mass 12, the mass flow rate of gas passing along the relatively lower flow resistance flow path 51 can be maintained greater than, equal to, or even less than the mass flow rate of gas passing along relatively higher flow resistance paths 53. By maintaining the mass flow rate of gases along the various flow paths in the fragmented mass 12 substantially the same, the primary combustion zone tends to advance through the fragmented mass uniformly, in a horizontal wave substantially normal to its direction of advancement.

In conjunction with or independently of maintaining gas flowing through flow paths 51, 53 at different temperatures for maintaining the primary combustion zone substantially flat, the oxygen mass flow rate of gas passing into the region 50 of relatively higher permeability can be maintained lower than the oxygen mass flow rate of gas passing into regions of relatively lower permeability in the fragmented mass 12 for limiting the rate of advancement of the combustion zone through the region 50 of higher permeability. When gas passing into the region 50 of higher permeability contains relatively less oxygen, the combustion zone in this region tends to advance slower. For example, if the oxygen mass flow rate of gas passing in the region 50 of relatively higher permeability is maintained at zero, there is substantially no advancement of the combustion zone through this region.

The temperature of various regions of the fragmented mass 12, and/or the oxygen mass flow rate of gas flowing in the various regions of the fragmented mass 12 can be controlled by maintaining the temperature and/or composition of the retort inlet mixture introduced to different regions of the fragmented mass different from each other. Thus, with reference to FIG. 2, the temperature and/or composition of the retort inlet mixture introduced through conduits 118 and 133 to regions of the fragmented mass of relatively lower permeability can be different from the temperature and/or composition of the retort inlet mixture introduced through the conduit 124 to the relatively higher permeability region 50 of the fragmented mass. For example, the temperature of the retort inlet mixture introduced through the conduit 124 can be higher than the temperature of the retort inlet mixture introduced through conduits 118 and 133. Such a difference in temperature can be achieved by preheating the retort inlet mixture or including steam in the retort inlet mixture introduced through the conduit 124. However, differences in temperature of the retort inlet mixtures introduced to various regions of the fragmented mass without differences in composition do not provide sufficient control for maintaining a flat primary combustion zone when there are substantial variations in gas flow permeability in the fragmented mass.

Different techniques can be used for maintaining the composition of the retort inlet mixtures introduced to different portions of the fragmented mass different from each other. For example, the rate of oxygen introduction through the conduit 124 to the fragmented mass can be maintained less than the rate of introduction of oxygen through the conduits 118 and 133. Thus, the rate of introduction of oxygen into the region 50 of relatively higher permeability is less than the rate of introduction of oxygen to regions of relatively lower permeability. This tends to equalize the rate of advancement of the primary combustion zone through the fragmented mass.

The amount of inert diluent such as nitrogen introduced to various locations in the fragmented mass can be different. For example, the same rate of introduction of oxygen through the conduits 118, 124, and 133 can be maintained, while more inert diluent is introduced through the conduit 124. Thus, the mass ratio of inert diluent to oxygen is higher in the relatively higher permeability region 50 than in relatively lower permeability regions in the fragmented mass. The additional diluent reduces the diversion of oxygen from regions of relatively low permeability into the relatively high permeability region 50.

A preferred diluent for the retort inlet mixture introduced through the conduit 124 is steam. This is because steam not only reduces the oxygen concentration of the retort inlet mixture, but also increases the temperature of the fragmented mass along the flow path 51 of relatively lower gas flow resistance.

The preferred method for maintaining a substantially flat primary combustion zone is by introducing fuel into a portion of the fragmented mass on the trailing side of the primary combustion zone for establishing a secondary combustion zone on the trailing side of the primary combustion zone, where the secondary combustion zone extends across the fragmented mass on the trailing side of only the portion of the primary combustion zone advancing through the region 50 of relatively higher gas flow permeability. Such a scheme is shown in FIG. 2, where there is a secondary combustion zone below the conduit 124 and above the portion of the primary combustion zone advancing through the region 50 of relatively higher gas flow premeability. The secondary combustion zone can be established and sustained by including fuel in the retort inlet mixture introduced through the conduit 124. Such a retort inlet mixture comprises fuel and at least sufficient oxygen for oxidizing the fuel. The oxygen of the retort inlet mixture can be provided by any oxygen containing gas. The fuel containing retort inlet mixture has a spontaneous ignition temperature less than the temperature of the primary combustion zone. Combustion of the fuel of the retort inlet mixture on the trailing side of the primary combustion zone results in establishment of a secondary combustion zone in the fragmented permeable mass.

As used herein, the term "secondary combustion zone" refers to the portion of the fragmented mass where the fuel of the retort inlet mixture is burned. The "primary combustion zone" is the portion of the fragmented mass where the greater part of the oxygen in the retort inlet mixture containing fuel that reacts with residual carbonaceous material in retorted oil shale is consumed. The term "retorted oil shale" refers to oil shale heated to a sufficient temperature to decompose kerogen in an environment substantially free of free oxygen so as to produce liquid and gaseous products and leave a soild carbonaceous residue.

As used herein, the "spontaneous ignition temperature" of a retort inlet mixture containing fuel refers to the spontaneous ignition temperature at the conditions in the retort. The spontaneous ignition temperature of a retort inlet mixture is dependent upon the conditions at which the formation particles in the retort are contacted by the mixture, i.e., the spontaneous ignition temperature of the retort inlet mixture is dependent upon such process parameters as the total pressure in the retort and the partial pressure of oxygen and fuel at that location in the retort and any catalytic effects of oil shale.

Advantages of retorting oil shale with a secondary combustion zone on the trailing side of the primary combustion zone are described in my aforementioned U.S. Patent Application Ser. No. 844,035.

The fuel for the retort inlet mixture can be a gaseous fuel such as post-retorting gas from an in situ oil shale retort, off gas from an active in situ oil shale retort (if the off gas is of sufficiently high heating value), butane, propane, natural gas, liquefied petroleum gas, or the like; a liquid fuel such as shale oil, crude petroleum oil, diesel fuel, alcohol, or the like; a comminuted solid fuel such as coal; and mixtures thereof. The retort inlet mixture caan also include liquid or gaseous water.

The presence of a secondary combustion zone on the trailing side of the portion of the primary combustion zone in the relatively higher permeability region 50 results in the temperature of fragmented mass that is in the region of relatively higher permeability and on the trailing side of the primary combustion zone being higher than the temperature of fragmented mass that is in the region of relatively lower permeability on the trailing side of the primary combustion zone. Therefore, the primary combustion zone feed passing into other portions of the primary combustion zone, and gas flowing through the flow path 51 of relatively lower gas flow resistance has a higher average temperature than gas flowing through the gas flow paths 53 of relatively higher gas flow resistance. As described above, this results in equalization of the rate of advancement of the primary combustion zone through the various regions in the fragmented mass.

Furthermore, oxygen of the retort inlet mixture introduced through the conduit 124 is consumed by combustion with fuel of the retort inlet mixture. This reduces the oxygen mass flow rate of the primary combustion zone feed passing into the portion of the primary combustion zone in the relatively higher permeability region 50. This also tends to limit the rate of advancement of the primary combustion zone through the relatively higher permeability region 50. If desired, sufficient fuel can be included in the retort inlet mixture introduced to the conduit 124 to substantially completely consume by combustion the oxygen introduced through the conduit 124.

Therefore, by sustaining a secondary combustion zone on the trailing side of the portion of the primary combustion zone in the relatively higher permeability region 50, two desirable effects are produced: (1) the average temperature of gass passing through the flow path 51 of relatively lower gas flow resistance is increased; and (2) the oxygen mass flow rate of gas passing into the primary combustion zone in the relatively higher permeability region 50 is reduced. Both of these effects tend to decrease the rate of advancement of the primary combustion zone through the relatively higher permeability region 50.

By selectively controlling the temperature and/or composition of the retort inlet mixture introduced to various locations in the fragmented mass according to principles of this invention, the volumetric flow rate of gas passing through the various flow paths in the fragmented mass can be substantially the same. Also, lateral gas flow between various flow paths in the fragmented mass can be inhibited. It is important to avoid such lateral gas flow to the relatively higher permeability region 50, because if excessive lateral gas flow occurs, oxygen introduced to relatively lower permeability regions of the fragmented mass can pass into the relatively higher permeability region 50. This would destroy the advantages obtained by reducing the oxygen concentration of gas introduced into the relatively higher permeability region 50.

The flow of oxygen into the region of relatively higher permeability can be inhibited by introducting the retort inlet mixture through the conduit 124 at a sufficiently high pressure that the pressure of gas flowing along the relatively lower gas flow resistance path or channel 51 is at least equal to the pressure of gas in the remainder of the fragmented mass. This results in gas flow out of the region of relatively higher permeability into adjoining regions of the fragmented mass and prevents oxygen from flowing laterally through the fragmented mass at the same elevation. If the pressures are equal, then there is substantially no gas flow between the gas flow path 51 of relatively lower flow resistance and the flow paths 53 of relatively higher gas flow resistance.

Although FIG. 2 shows a secondary combustion zone on the trailing side of only the portion of the primary combustion zone in the relatively higher permeability region 50, a secondary combustion zone can be established in other portions of the fragmented mass as well to obtain the advantages associated with a secondary combustion zone. However, the gas passing from the secondary combustion zone above the region 50 of relatively higher permeability should have a higher temperature and/or a lower oxygen mass flow rate than gas passing from a secondary combustion zone on the trailing side of portions of the primary combustion zone in regions of relatively lower permeability. At the same rate of introduction of oxygen through the conduits shown in FIG. 2, this can be effected by introducing more fuel and/or a fuel of a higher heating value through the conduit 124 than the other conduits. In other words, the mass ratio of fuel to oxygen in the retort inlet mixture introduced through the conduit 124 can be maintained higher than the mass ratio of fuel to oxygen of the retort inlet mixture introduced through the conduits 118, 133.

A situation for which it can be desirable to have more than one secondary combustion zone on the trailing side of the primary combustion zone is when the fragmented mass comprises three fluid paths of different gas flow resistance: a first path having a relatively low flow resistance; a second path having a relatively intermediate flow resistance; and a third path having a relatively high gas flow resistance. In this situation, the primary combustion zone can be maintained substantially planar by establishing and sustaining a secondary combustion zone on the trailing side of the primary combustion zone advancing through only the portions of the fragmented mass containing the first and second fluid flow paths. The secondary combustion zone on the trailing side of the primary combustion zone advancing through the region of the fragmented mass containing the first fluid flow path is hotter than the other secondary combustion zone.

Control of channelling according to principles of this invention is believed to be effective over only a portion of the length of the retort 8 due to lateral mixing of gas as it flows through the fragmented mass. It is believed that control is effective for only about "r" feet below the location in the fragmented mass at which gas is introduced to the fragmented mass, where "r" is equal to one-half of the equivalent diameter of the retort. The equivalent diameter of a retort is the diameter of a circle which has an area equal to the cross-sectional area of the retort. For example, a retort which is 120 feet square in cross-section has an equivalent radius of 68 feet ($r=[120\times 120/pi]^{\frac{1}{2}}$). Therefore, avoidance of gas flow to the channelled region of the fragmented mass can be inhibited for only about r feet from where the retort inlet mixture is introduced to the fragmented mass. Once the primary combustion zone has advanced about r feet through the fragmented mass from the location in the fragmented mass at which retort inlet mixture is being introduced, maintanance of the secondary zone can be stopped, or a secondary combustion zone can be established on the trailing side of substantially all of the primary combustion zone. Although the rate of advancement of the primary combustion zone cannot be controlled throughout the entire retorting process, such control can have a significant impact on the total production from a retort.

This lack of control of advancement of the primary combustion zone after it has advanced about r feet from where gas is introduced to the fragmented mass may be compensated for by advancing the primary combustion zone farther in regions without channelling than in regions with channelling during the period when there is control. This can be accomplished by maintaining a relatively rapid rate of advance in the non-channeled regions while suppressing the rate of advance in channeled regions. Such an operation can be conducted when the primary combustion is advancing through the top r feet of the fragmented mass. Thereafter, control can be abandoned. During this later time, the portion of the primary combustion zone in the channeled regions advances more rapidly than the portion of the primary combustion zone in the non-channeled regions. This causes the primary combustion zone in the channeled regions to gradually catch up with, and possibly pass the primary combustion zone in the non-channeled regions.

By maintaining the primary combustion zone substantially planar and substantially normal to its direction of advancement through the fragmented mass according to the present invention, higher yield can be obtained than if the primary combustion zone were skewed. This is because shale oil produced in the retorting zone is not consumed by combustion in advanced portions of the primary combustion zone, and produced shale oil does not undergo excessive secondary cracking. An advantage of a method according to the present invention is that no special equipment or conduits are required for control of the advancement of the primary combustion zone. The same conduits used for introducing retort inlet mixture to the retort 8 are required, whether or not control is needed. In addition, because of the advantages which can be obtained with the secondary combustion zone, as described in the aforementioned Application Ser. No. 844,035, piping for introducing fuel to the fragmented mass is provided regardless of the need for control.

Figure 3:
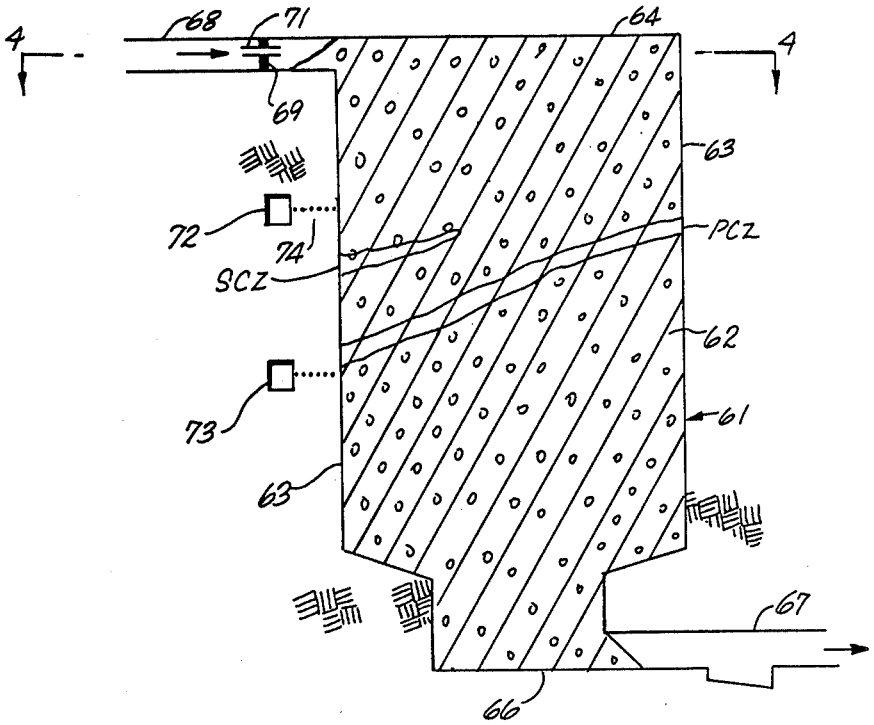
FIG. 3 is a semi-schematic vertical cross section of another embodiment of retort for practice of this invention.
Figure 4:
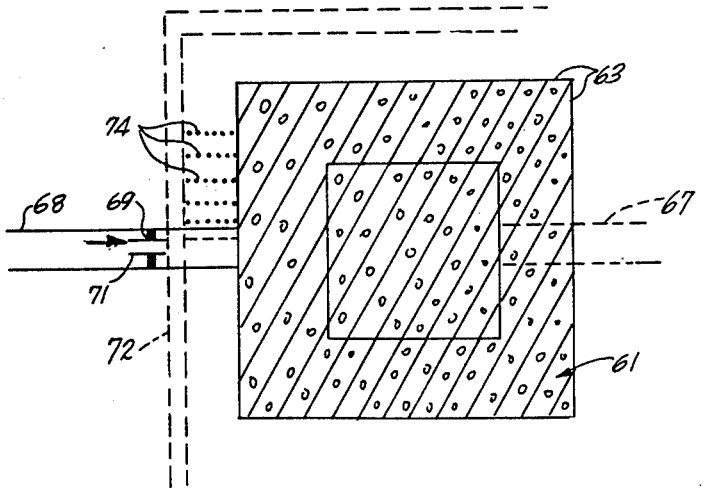
FIG. 4 is a view downwardly in the retort of FIG. 3.

In the embodiment hereinabove described and illustrated in FIGS. 1 and 2, a retort inlet mixture was introduced at various locations across the top of an in situ oil shale retort for establishing a primary combustion zone and advancing the primary combustion zone downwardly through the fragmented mass in the retort. Fuel was introduced in at least some regions of the fragmented mass for maintaining a secondary combustion zone on the trailing side of the primary combustion zone. If desired, fuel for maintaining such a secondary combustion zone on the trailing side of the primary combustion zone can be introduced at locations in the fragmented mass other than the top. Such a technique can be practiced in an arrangement as illustrated in FIGS. 3 and 4.

As illustrated in this embodiment an in situ oil shale retort 61 is formed in a subterranean formation containing oil shale. The retort contains a fragmented permeable mass 62 of formation particles containing oil shale. The fragmented mass is in a cavity having vertically extending side bounaries 63, a top boundary 64 and bottom boundary 66. A production level drift 67 is in communication with the bottom of the fragmented mass at the lower boundary for withdrawing liquid and gaseous products. An air level drift 68 is in communication with the top of the fragmented mass adjacent the upper boundary 64. The air level drift communicates with the fragmented mass in this embodiment adjacent one side boundary and the production level drift communicates with the bottom of the fragmented mass adjacent the opposite side.

A bulkhead 69 is mounted in the air level drift with a conduit 71 therethrough for introducing a retort inlet mixture to the fragmented mass. Thus, the general gas flow path from the inlet to the outlet is more or less diagonally across the fragmented mass, although the actual gas flow path through the fragmented mass is influenced at least in part by the distribution of void fraction within the fragmented mass. Thus, for example, when an open void space (not shown) is left between the top of the fragmented mass in the retort and the upper boundary 64, substantial lateral flow of the retort inlet mixture occurs over the top of the fragmented mass and hence downwardly through the mass.

In the illustrated embodiment an upper intermediate level drift 72 extends through unfragmented formation near one or more of the side boundaries of the retort at an elevation intermediate between the elevations of the upper and lower boundaries of the fragmented mass. Similarly, a lower intermediate level drift 73 extends through unfragmented formation adjacent one or more side boundaries of the retort at an elevation between the upper intermediate level drift 72 and the production level drift 67. Bore holes 74 can be drilled from the adjacent drifts 72 and/or 73 to the side boundary of the fragmented mass for fluid communication with the mass. This permits withdrawing of gas samples, insertion of thermocouples, or, as in practice of this invention, introduction of fuel for maintaining a secondary combustion zone.

In FIG. 3 a primary combustion zone PCZ is illustrated at an intermediate elevation in the fragmented mass and somewhat skewed with respect to a horizontal plane. Such skewing can, for example, occur when a first fluid flow path through the fragmented mass has a relatively higher gas permeability than a second fluid flow path through the fragmented mass. As described above, a secondary combustion zone can be maintained on a portion of the trailing side of the primary combustion zone for promoting a flat, substantially horizontal primary combustion zone in the fragmented mass. Such a secondary combustion zone can be established in the relatively higher permeability fluid flow path for reducing the rate of advance of the primary combustion zone along that higher permeability path.

Thus, as illustrated in FIG. 3, a secondary combustion zone SCZ is established in the fragmented mass on the trailing side of the primary combustion zone. The secondary combustion zone in this embodiment extends across only a portion of the primary combustion zone normal to its direction of advancement for limiting the rate of advance of that portion of the primary combustion zone. Fuel for maintaining the secondary combustion zone is introduced through at least a portion of the bore holes 74 from the upper intermediate level drift 72 to the side boundary of the fragmented mass. The fuel introduced mixes with gas introduced from the air level drift 68 and burns in a secondary combustion zone when the mixture reaches a region in the spent shale at its ignition temperature.

Introduction of fuel at an intermediate elevation for maintaining a secondary combustion zone can be advantageous for promoting control of the locus of the secondary combustion zone. Thus, for example, the distribution of fuel into the fragmented mass can be localized to a region having relatively high gas permeability with little or no fuel being added in other regions of the fragmented mass.

The arrangement illustrated in FIG. 3 is essentially a snapshot in time with the primary and secondary combustion zones in the locations illustrated. At an earlier time interval when the primary combustion zone is at an elevation above the elevation of the upper intermediate level drift 72, a secondary combustion zone can be maintained by introduction of fuel at the elevation of the air level drift, either via that drift or an auxiliary drift (not shown). At a later time interval, as the primary combustion zone approaches the bottom boundary of the fragmented mass, fuel can be introduced from the lower intermediate level drift 73 for maintaining a secondary combustion zone at a selected locus on the trailing side of the primary combustion zone. Such arrangements permit appreciable flexibility in locating the secondary combustion zone for control of the locus of the primary combustion zone advancing through the fragmented mass in the retort.

This process is further illustrated with reference to the following example.

EXAMPLE

An in situ oil shale retort was formed according to the working example described in the aforementioned U.S. Pat. No. 4,118,071. A fragmented mass of particles about 120 feet square (r=68 feet) and extending about 210 feet above a production level access drift was formed by explosive expansion of formation in the retort site toward a vertically extending slot. Blasting holes were drilled downwardly in the formation for placement of explosive for formation of the fragmented mass. A horizontal sill pillar of unfragmented formation overlaying the fragmented mass was left after blasting. During retorting, gases were introduced to the fragmented mass through the portions of some of the blasting holes extending through the sill pillar. In the fragmented mass, there existed a region 50 of high permeability. The top portion of the region 50 included a pocket which tapered, averaged about 80 feet in length, 4 feet in height, 17 feet in width and had an estimated volume of 5,600 cubic feet.

Figure 1:
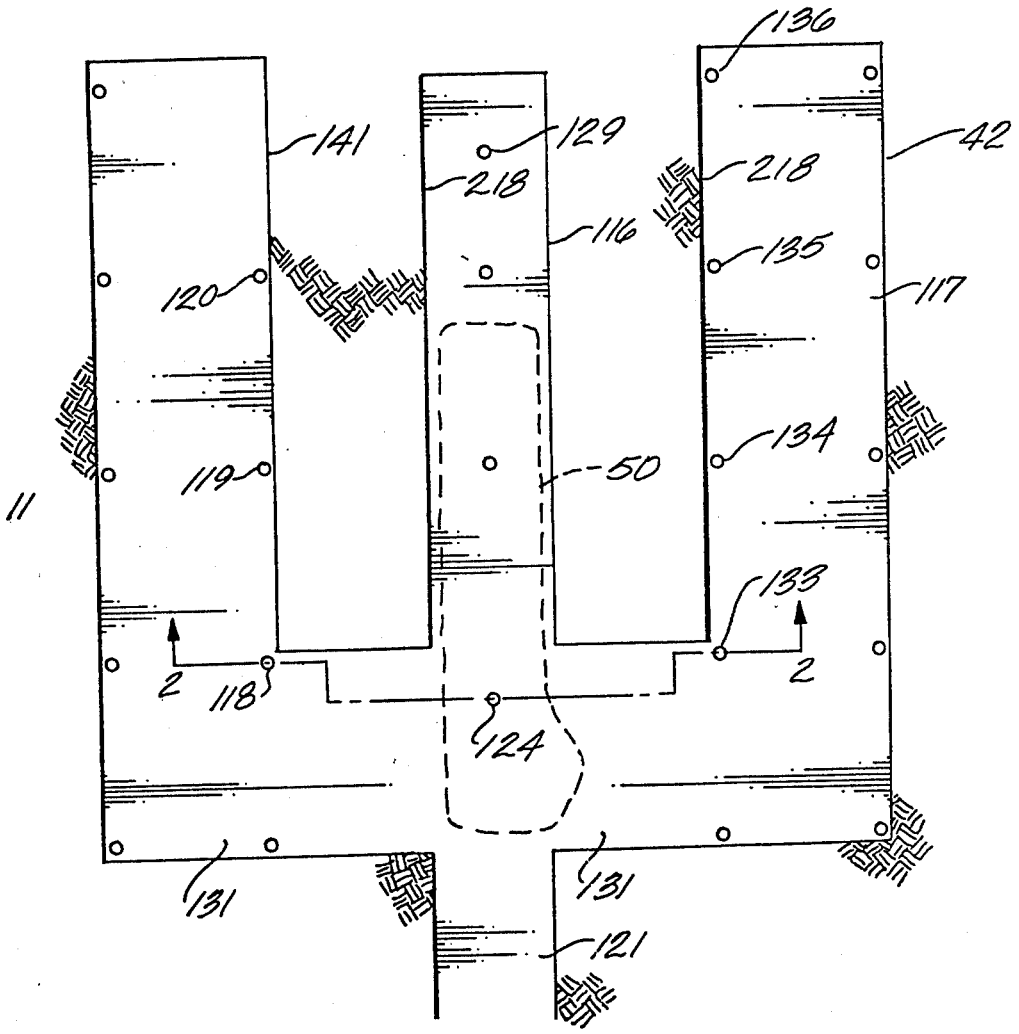
FIG. 1 is a plan view of a base of operation of an in situ oil shale retort for which practice of this invention is useful.

The layout of the base of operation of such a retort is shown semi-schematically in FIG. 1. The base of operation had a central drift 116 with a side drift 117, 141 on either side thereof. The two side drifts 117, 141 were similar to each other. Elongated roof supporting pillars 218 of intact formation separated the side drifts 117 and 141 from the central drift 116. Short cross-cuts 131 interconnected the side drifts 117 and 141, and the central drift 116 to form a generally E-shaped excavation. A branch drift 121 provided access to the base of operation from other underground mining development (not shown) at the elevation of the base of operation.

Holes used for introducing gas to the retort during the retorting operation are shown in FIG. 2. There was a bore hole 124 for introducing gas at the juncture of the cross-cuts 119 and central drift 116 and another bore hole 129 near the end of the central drift. The right side drift 117 had four of these bore holes along the pillar 218, with the first bore hole 133 proximate to the junction of the cross-cut 119 and the drift 117, and with bore holes 134, 135, and 136 in a row along the pillar toward the end of the right side drift 117. The left side drift 141 contained three bore holes 118, 119, and 120 used for introducing gas. These three bore holes were along the side pillar 218 in positions mirroring the positions of blasting holes 133, 134, and 135, respectively. Each bore hole contained a casing.

The region 50 of high permeability was substantially directly below bore hole 124.

A primary combustion zone was established and advanced through the fragmented mass, without a secondary combustion zone. The methane production rate was higher than expected, indicating that at least a portion of the combustion zone had advanced as a "wedge" or "spike" through the region of high permeability to a layer of rich oil shale in the fragmented mass. A secondary combustion zone was established in the region of relatively higher permeability at a location below the bottom of the void. Upon establishment of this secondary combustion zone, the rate of methane production decreased, indicating that further advance of the primary combustion zone into the relatively rich oil shale had been retarded.

Although this invention has been described in considerable detail with reference to certain versions thereof, other versions are within the scope of this invention. For example, although the drawings show a retort where there is a sill pillar above the fragmented mass, this invention is also useful for retorts not having a sill pillar.

In addition, although the invention has been described in terms of an in situ oil shale retort containing both a primary combustion zone and a retorting zone, it is possible to practice this invention with a retort containing only a primary combustion zone. Also, although FIG. 1 shows a retort where the primary combustion zone and the retorting zone are advancing downwardly through the retort, this invention is also useful for retorts where the primary combustion zone and the retorting are advancing upwardly or transverse to the vertical.

Because of variations such as these, the spirit and scope of the appended claims should not necessarily be limited to the description of the preferred versions contained herein.

What is claimed is:

1. In a method for recovering liquid and gaseous products from an in situ oil shale retort in a subterranean formation containing oil shale, the in situ oil shale retort containing a fragmented permeable mass of formation particles containing oil shale and having a top boundary, a bottom boundary, and side boundaries, the fragmented mass having a first gas flow path with a first gas flow resistance and a second gas flow path in parallel with the first gas flow path with a relatively lower gas flow resistance than the gas flow resistance of the first gas flow path, comprising the steps of:

establishing a primary combustion zone in an upper portion of the fragmented permeable mass near the top boundary, said primary combustion zone extending generally horizontally in the fragmented mass;

introducing a retort inlet mixture comprising oxygen containing gas to the fragmented mass near the top boundary for sustaining the primary combustion zone;

withdrawing an off gas from the fragmented mass near the bottom boundary, whereby gas flow from the top boundary toward the bottom boundary advances the primary combustion zone downwardly through the fragmented mass, and establishes and advances a retorting zone on the advancing side of the primary combustion zone wherein oil shale in the fragmented mass is retorted to produce liquid and gaseous products, such gaseous products being withdrawn from the retort in off gas;

the improvement comprising:

controlling the composition of the retort inlet mixture such that a first gas having a first oxygen mass flow rate passes into the portion of the combustion zone in the first gas flow path having relatively higher gas flow resistance and a second gas having a second oxygen mass flow rate lower than the first oxygen mass flow rate passes into the portion of the combustion zone in the second region having relatively lower gas flow resistance for maintaining the rate of advancement of the combustion zone through the first gas flow path and the second gas flow path substantially the same.

2. The method of claim 1 in which the volumetric flow rate of the gas passing into the portion of the combustion zone in the first gas flow path is substantially equal to the volumetric flow rate of the gas passing into the portion of the combustion zone in the second gas flow path.

3. The method of claim 1 in which the second oxygen mass flow rate is about zero.

4. The method of claim 1 in which the pressure of gas at locations in at least a portion of the second gas flow path is greater than the pressure of gas at locations of the first gas flow path at the same elevation.

5. The method of claim 1 in which "r" is equal to one-half of the equivalent diameter of the retort in feet, wherein there is substantially no gas flow from the top r feet of the first gas flow path to the top r feet of the second gas flow path.

6. A method for maintaining a substantially flat combustion zone advancing through a fragmented permeable mass of formation particles containing oil shale, the fragmented mass comprising a first region having a first fluid path therethrough, the first path having a first gas permeability, the fragmented mass comprising a second region having a second fluid path therethrough, the second path having a gas permeability different from the first gas permeability, the method comprising the steps of:

introducing fluid containing oxygen to the fragmented mass for advancing the combustion zone through the fragmented mass and for flow of gas along the first and second flow paths;

maintaining gas flowing through the first flow path at a first average temperature; and maintaining gas flowing through the second flow path at a second average temperature, the second average temperature being sufficiently different from the first average temperature to provide substantially equal rates of advancement of the combustion zone through the fragmented mass in the first and second regions.

7. The method of claim 6 in which the gas permeability of the first path is lower than the gas permeability of the second path, wherein the second average temperature is higher than the first average temperature.

8. The method of claim 6 in which the volumetric flow rate of gas passing into the portion of the combustion zone in the first gas flow path is substantially equal to the volumetric flow rate of the gas passing into the portion of the combustion zone in the second gas flow path.

9. A method for operating an in situ oil shale retort in a subterranean formation containing oil shale, the retort containing a fragmented permeable mass of formation particles containing oil shale, the fragmented mass having a primary combustion zone advancing therethrough, the method comprising the steps of:

introducing a first gas having a first composition into a first region of the fragmented mass having a first fluid path therethrough, the first path having a first gas permeability, and introducing a second gas having a second composition into a second region of the fragmented mass having a second fluid path therethrough, the second path in parallel with the first path and having a second gas permeability different from the first gas permeability, the second composition being sufficiently different from the first composition to provide substantially equal rates of advancement of the primary combustion zone through the fragmented mass in at least a portion of the first and second regions.

10. The method of claim 9 in which the gas permeability of the first region is lower than the gas permeability of the second region, and including the step of maintaining the average temperature of fragmented mass that is in the second region and on the trailing side of the combustion zone higher than the average temperature of fragmented mass that is in the first region and on the trailing side of the combustion zone.

11. The method of claim 9 including the step of maintaining the temperature of the combustion zone in the first region different from the temperature of the combustion zone in the second region.

12. The method of claim 9 including the step of maintaining the average temperature of fragmented mass that is on the trailing side of the combustion zone and in the first fluid path different from the average temperature of fragmented mass that is on the trailing side of the combustion zone and in the second fluid path.

13. The method of claim 9 in which the second gas permeability is lower than the first gas permeability, and at least the second gas contains oxygen, including the step of maintaining the concentration of oxygen in the second gas higher than the concentration of oxygen in the first gas.

14. The method of claim 9 in which the volumetric flow rate of gas passing into the portion of the combustion zone in the first gas flow path is substantially equal to the volumetric flow rate of the gas passing into the combustion zone in the second gas flow path.

15. The method of claim 9 including the steps of:

(a) establishing a secondary combustion zone in at least one region on the trailing side of the primary combustion zone; and (b) introducing fuel and oxygen to the secondary combustion zone for sustaining the secondary combustion zone.

16. A method for recovering liquid and gaseous products from an in situ oil shale retort in a subterranean formation containing oil shale, the in situ oil shale retort containing a fragmented permeable mass of formation particles containing oil shale and having a top boundary, a bottom boundary, and side boundaries, comprising the steps of:

(a) identifying a first region of the fragmented mass having a first gas flow path with a first gas flow permeability, and identifying a second region of the fragmented mass having a second gas flow path with a relatively higher gas flow permeability than the gas flow permeability of the first gas flow path:

(b) establishing a primary combustion zone in an upper portion of the fragmented permeable mass near the top boundary, said primary combustion zone extending generally horizontally in the fragmented mass;

(c) introducing oxygen containing gas to the fragmented mass near the top boundary for advancing the primary combustion zone through the fragmented mass and for passing gas through the first and second flow paths;

(d) maintaining gas flowing through the first flow path at a first average temperature; and (e) maintaining gas flowing through the second flow path at a second average temperature, the second average temperature being sufficiently higher than the first average temperature to provide substantially equal rates of advancement of the combustion zone through the fragmented mass in the first and second regions.

17. The method of claim 16 including the step of maintaining the temperature of fragmented mass that is in the second region and on the trailing side of the combustion zone higher than the temperature of fragmented mass that is in the first region and on the trailing side of the primary combustion zone.

18. The method of claim 17 including the step of establishing a secondary combustion zone in fragmented mass that is in the second region and on the trailing side of the primary combustion zone.

19. The method of claim 18 including the step of introducing fuel and oxygen to the secondary combustion zone for sustaining the secondary combustion zone.

20. The method of claim 19 wherein fuel is introduced to the fragmented mass in a region between the top boundary and the bottom boundary for sustaining the secondary combustion zone.

21. The method of claim 16 in which the step of identifying comprises passing gaseous tracer means through the fragmented mass.

22. A method for recovering liquid and gaseous products from an in situ oil shale retort in a subterranean formation containing oil shale, said retort containing a fragmented permeable mass of formation particles containing oil shale, comprising the steps of:

establishing a primary combustion zone in the fragmented mass;

introducing an oxygen containing gas into the fragmented mass for sustaining the primary combustion zone and for advancing the primary combustion zone through the fragmented mass; and introducing fuel into a portion of the fragmented mass on the trailing side of the primary combustion zone for establishing a secondary combustion zone on the trailing side of the primary combustion zone, said secondary combustion zone extending across only a portion of the primary combustion zone normal to its direction of advancement for limiting the rate of advance of such portion of the primary combustion zone through the fragmented mass.

23. The method of claim 22 in which oxygen containing gas is introduced to the fragmented permeable mass at a plurality of locations for sustaining the primary combustion zone and for advancing the primary combustion zone through the fragmented mass, wherein fuel is introduced to the fragmented mass at only a portion of such locations for establishing and sustaining a secondary combustion zone at only a portion of such locations.

24. The method of claim 23 in which different amounts of fuel are introduced at different locations.

25. The method of claim 23 in which the mass ratio of fuel to oxygen at at least two of such locations is different.

26. The method of claim 23 in which sufficient fuel is introduced to at least a portion of such locations to substantially completely consume by combustion the oxygen introduced to such locations.

27. The method of claim 22 in which oxygen containing gas is introduced to the fragmented permeable mass at a location adjacent an end boundary of the fragmented mass for sustaining the primary combustion zone and for advancing the primary combustion zone through the fragmented mass, and wherein fuel is introduced to the fragmented mass at a different location between end boundaries of the fragmented mass sustaining the secondary combustion zone.

28. The method of claim 22 in which all portions of the primary combustion zone advance through the fragmented mass at about the same rate.

29. The method of claim 22 in which the rate of introduction of fuel to various portions of the fragmented mass is controlled to maintain the primary combustion zone substantially planar.

30. A method for recovering liquid and gaseous products from an in situ oil shale retort in a subterranean formation containing oil shale, said retort containing a fragmented permeable mass of formation particles containing oil shale, comprising the steps of:

establishing a primary combustion zone in the fragmented mass;

introducing an oxygen containing gas to the fragmented mass for sustaining the primary combustion zone and for advancing the primary combustion zone through the fragmented mass; and introducing an inert diluent into a portion of the fragmented mass on the trailing side of the primary combustion zone for reducing the oxygen concentration of gas passing into the primary combustion zone across only a portion of the primary combustion zone for limiting the rate of advance of such portion of the primary combustion zone through the fragmented mass.

31. The method of claim 30 in which oxygen containing gas is introduced to the fragmented permeable mass at a plurality of locations for sustaining the primary combustion zone and for advancing the primary combustion zone through the fragmented mass, wherein inert diluent is introduced to the fragmented mass at only a portion of such locations.

32. The method of claim 31 in which different amounts of inert diluent are introduced at different locations.

33. The method of claim 31 in which the mass ratio of inert diluent to oxygen at at least two of such locations is different.

34. A method for recovering liquid and gaseous products from an in situ oil shale retort in a subterranean formation containing oil shale, the in situ oil shale retort containing a fragmented permeable mass of formation particles containing oil shale and having a top boundary, a bottom boundary, and side boundaries, the fragmented mass having a first gas flow path between the top boundary and the bottom boundary with a first gas flow permeability and a second gas flow path between the top boundary and the bottom boundary with a relatively higher gas flow permeability than the gas flow permeability of the first gas flow path, comprising the steps of:

establishing a primary combustion zone in an upper portion of the fragmented permeable mass near the top boundary, said primary combustion zone extending generally horizontally in the fragmented mass;

introducing oxygen containing gas to the fragmented mass near the top boundary for sustaining the primary combustion zone;

withdrawing an off gas from the fragmented mass near the bottom boundary, whereby gas flow from the top boundary toward the bottom boundary advances the primary combustion zone downwardly through the fragmented mass, and establishes and advances a retorting zone on the advancing side of the primary combustion zone wherein oil shale in the fragmented mass is retorted to produce liquid and gaseous products, such gaseous products being withdrawn from the retort in off gas; the improvement comprising:

introducing fuel to fragmented mass in the second gas flow path for establishing a secondary combustion zone in a portion of the fragmented mass so that the oxygen concentration of gas entering the portion of the primary combustion zone downstream from the secondary combustion zone is less than the oxygen concentration of gas introduced into the primary combustion zone in the first gas flow path.

35. The method of claim 34 wherein fuel is introduced to the fragmented mass at a location between the top boundary and the bottom boundary for sustaining the secondary combustion zone.

36. The method of claim 34 in which the rate of introduction of fuel to fragmented mass in the second gas flow path is controlled to maintain the primary combustion zone substantially planar.

37. The method of claim 34 in which all portions of the primary combustion zone advance through the fragmented mass at about the same rate.

38. A method for maintaining a substantially flat combustion zone advancing through a fragmented permeable mass of formation particles containing oil shale, the fragmented mass comprising a first region having a first fluid path therethrough, the first path having a first gas permeability, the fragmented mass comprising a second region having a second fluid path therethrough, the second path being in parallel with the first path and having a gas permeability relatively higher than the first gas permeability, the method comprising the steps of:

introducing a first gas having a first temperature to the first region of the fragmented mass; and introducing a second gas having a second temperature to the second region of the fragmented mass, the second temperature being sufficiently higher than the first temperature to provide substantially equal rates of advancement of the combustion zone through the fragmented mass in the first and second regions.

39. The method of claim 38 in which the second gas contains substantially no oxygen.

40. The method of claim 38 including the step of introducing a retort inlet mixture comprising fuel and oxygen to the fragmented mass for generating the second gas having the second termperature.

41. A method for recovering liquid and gaseous products from an in situ oil shale retort in a subterranean formation containing oil shale, the retort containing a fragmented permeable mass of formation particles, the mass comprising a first region having a first gas flow path having a first gas permeability, and the mass comprising a second region having a second gas flow path in parallel with the first gas flow path and having a second gas permeability different from the first gas permeability, comprising the steps of:

establishing a primary combustion zone in the fragmented mass;

introducing an oxygen containing gas to the fragmented mass for sustaining the primary combustion zone and for advancing the primary combustion zone through the fragmented mass;

maintaining fragmented mass that is in the first region and on the trailing side of the primary combustion zone at a first average temperature; and maintaining fragmented mass that is in the second region and on the trailing side of the primary combustion zone at a second average temperature, the second average temperature being sufficiently different from the first average temperature to provide substantially equal rates of advancement of the primary combustion zone through the fragmented mass in at least a portion of the first and second regions.

42. The method of claim 41 in which the second gas permeability is higher than the first gas permeability, and the second temperature is higher than the first temperature.

43. The method of claim 42 in which the step of maintaining the fragmented mass that is in the second region and on the trailing side of the primary combustion zone at a second temperature comprises establishing a secondary combustion zone in fragmented mass that is in the second region and on the trailing side of the primary combustion zone.

44. The method of claim 42 in which the step of maintaining fragmented mass that is in the second region and on the trailing side of the primary combustion zone at a second temperature comprises introducing fuel to the fragmented mass that is in the second region and on the trailing side of the primary combustion zone.

45. The method of claim 44 in which fuel is introduced to the fragmented mass at a location different from the location where the oxygen containing gas is introduced to the fragmented mass.

46. The method of claim 44 in which fuel is introduced to the fragmented mass downstream of the location where the oxygen containing gas is introduced to the fragmented mass.

47. The method of claim 41 in which the volumetric flow rate of gas passing into the portion of the combustion zone in the first gas flow path is substantially equal to the volumetric flow rate of the gas passing into the combustion zone in the second gas flow path.

48. A method for operating an in situ oil shale retort in a subterranean formation containing oil shale, the retort containing a fragmented permeable mass of formation particles containing oil shale, the fragmented mass having a first region having a first gas flow path having a first gas permeability and a second region having a second gas flow path having a second gas permeability higher than the first gas permeability, comprising the steps of:

establishing a primary combustion zone in the fragmented mass;

introducing an oxygen containing gas to the fragmented mass for sustaining the primary combustion zone and for advancing the primary combustion zone through the fragmented mass; and establishing and maintaining a secondary combustion zone on the trailing side of only the portion of the primary combustion zone advancing through the second region for limiting the rate of advance of such portion of the primary combustion zone through the fragmented mass.

49. The method of claim 48 wherein "r" is equal to one-half the equivalent diameter of the retort in feet, and wherein maintenance of the secondary combustion zone is stopped after the primary combustion zone has advanced about r feet through the fragmented mass from the location in the fragmented mass at which the oxygen containing gas is introduced to the fragmented mass.

50. The method of claim 48 in which "r" is equal to one-half the equivalent diameter of the retort in feet, and including the step of maintaining a secondary combustion zone on the trailing side of substantially all of the primary combustion zone after the primary combustion zone has advanced through fragmented mass about r feet from the location in the fragmented mass at which the oxygen containing gas is introduced to the fragmented mass.

51. The method of claim 48 in which the gas flowing through the second flow path is at a higher average temperature than the average temperature of gas flowing through the first flow path.

52. A method for maintaining a substantially flat combustion zone advancing through a fragmented permeable mass of formation particles containing oil shale in an in situ oil shale retort in a subterranean formation containing oil shale, the method comprising the steps of:

introducing a first retort inlet mixture containing oxygen and having a first composition into a first region of the fragmented mass having a first fluid path therethrough, the first path having a first gas permeability; and introducing a second retort inlet mixture containing oxygen and having a second composition into a second region of the fragmented mass having a second fluid path therethrough, the second path having a second gas permeability higher than the first gas permeability, the second composition being sufficiently different from the first composition to provide substantially equal rates of advancement of the combustion zone through the fragmented mass in at least a portion of the first and second regions.

53. The method of claim 52 in which the second retort inlet mixture contains fuel.

54. The method of claim 53 in which the first retort inlet mixture contains the same fuel as the second retort inlet mixture, wherein the mass ratio of oxygen to fuel in the second retort inlet mixture is lower than the mass ratio of oxygen to fuel in the first retort inlet mixture.

55. The method of claim 52 in which the first retort inlet mixture contains a first fuel having a first heating value, and the second retort inlet mixture contains a second fuel having a second heating value which is higher than the first heating value.

56. A method for operating an in situ oil shale retort in a subterranean formation containing oil shale, the retort containing a fragmented permeable mass of formation particles containing oil shale, the fragmented mass having a first region having a first gas flow path having a first gas permeability and a second region having a second gas flow path having a second permeability higher than the first gas permeability, comprising the steps of:

establishing a primary combustion zone in the fragmented mass;

introducing a retort inlet mixture comprising oxygen to the fragmented mass for sustaining the primary combustion zone and for advancing the primary combustion zone through the fragmented mass; and controlling the rate and composition of the retort inlet mixture such that a first gas having a first oxygen mass flow rate passes into the portion of the combustion zone in the first gas flow path and a second gas having a second oxygen mass flow rate lower than the first oxygen mass flow rate passes into the portion of the combustion zone in the second region for maintaining the rate of advancement of the combustion zone through the first gas flow path and the second gas flow path substantially the same.

57. The method of claim 56 in which the volumetric flow rate of gas passing into the portion of the combustion zone in the first gas flow path is substantially equal to the volumetric flow rate of the gas passing into the combustion zone in the second gas flow path.

58. The method of claim 56 in which the second oxygen mass flow rate is about zero.

59. A method for establishing a substantially flat primary combustion zone advancing through a fragmented permeable mass of formation particles containing oil shale, the fragmented mass comprising a first region having a first fluid path therethrough, the first path having a first gas permeability, the fragmented mass comprising a second region having a second fluid path therethrough, the second path being in parallel with the first fluid path and having a gas permeability higher than the first gas permeability, the method comprising the steps of:

establishing a primary combustion zone in the first region of the fragmented mass;

introducing a first retort inlet mixture containing oxygen to the first region of the fragmented mass for advancing the primary combustion zone through the first region of the fragmented mass and for flow of gas along the first flow path; and introducing to the second region of the fragmented permeable mass a second retort inlet mixture containing oxygen and at least sufficient fuel for consuming the oxygen by oxygenation to generate a hot combustion gas substantially free of free oxygen for flow along the second flow path for inhibiting advancement of the primary combustion zone through the second region of the fragmented permeable mass.

60. The method of claim 59 including the following steps:

maintaining gas flowing through the first flow path at a first average temperature; and maintaining gas flowing through the second flow path at a second average temperature, the second average temperature being sufficiently higher than the first averge temperature to provide substantially equal rates of advancement of the combustion zone through the fragmented mass in the first and second regions.

61. The method of claim 60 wherein "r" is equal to one-half the equivalent diameter of the retort, and wherein the step of maintaining gas flowing through the second flow path at an average temperature higher than the first average temperature is stopped after the primary combustion zone has advanced about r feet through the fragmented mass from the location in the fragmented mass at which the first retort inlet mixture is introduced.

62. The method of claim 59 wherein the first retort inlet mixture comprises fuel and more than sufficient oxygen for oxidizing the fuel for establishing and sustaining a secondary combustion zone in the fragmented mass on the trailing side of the portion of the primary combustion zone in the first region.

63. A method for recovering liquid and gaseous products from an in situ oil shale retort in a subterranean formation containing oil shale, the in situ oil shale retort containing a fragmented permeable mass of formation particles containing oil shale and having a top boundary, a bottom boundary, and side boundaries, the fragmented mass having a first gas flow path extending at least part way between the top boundary and the bottom boundary with a first gas flow permeability and a second gas flow path extending at least part way between the top boundary and the bottom boundary with a relatively higher gas flow permeability than the gas flow permeability of the first gas flow path, at least a portion of the second gas flow path being in parallel with a portion of the first gas flow path, comprising the steps of:

establishing a primary combustion zone in an upper portion of the fragmented permeable mass near the top boundary, said primary combustion zone extending generally horizontally in the fragmented mass;

introducing oxygen containing gas to the fragmented mass near the top boundary for sustaining the primary combustion zone;

Withdrawing an off gas from the fragmented mass near the bottom boundary, whereby gas flow from the top boundary toward the bottom boundray advances the primary combustion zone downwardly along the first and second gas flow paths through the fragmented mass, and establishes and advances a retorting zone on the advancing side of the primary combustion zone wherein oil shale in the fragmented mass is retorted to produce liquid and gaseous products, such gaseous products being withdrawn from the retort in off gas; the improvement comprising:

introducing fuel to fragmented mass in the second gas flow path for establishing a secondary combustion zone in a portion of the fragmented mass upstream from a portion of the primary combustion zone in the second gas flow path.

64. The method of claim 63 wherein fuel is introduced to the fragmented mass at the location between the top boundary and the bottom boundary for sustaining the secondary combustion zone.

* * * * *

UNITED STATES PATENT AND TRADEMARK OFFICE

CERTIFICATE OF CORRECTION

PATENT NO. : 4,246,965

DATED : January 27, 1981

INVENTOR(S) : Chang Yul Cha

It is certified that error appears in the above—identified patent and that said Letters Patent is hereby corrected as shown below:

Column 1, line 45, "4,118,701" should be -- 4,118,071 --.

Column 6, line 44 "is" should be -- in --.
Column 7, line 66 "if" should be -- of --.

Column 12, line 68 "caan" should be -- can --.
Column 13, line 36 "gass" should be -- gas --.

Signed and Sealed this

Second Day of June 1981

[SEAL]

Attest:

RENE D. TEGTMEYER

Attesting Officer

Acting Commissioner of Patents and Trademarl